US008303273B2

(12) United States Patent
Kang et al.

(10) Patent No.: US 8,303,273 B2
(45) Date of Patent: Nov. 6, 2012

(54) LINEAR COMPRESSOR

(75) Inventors: Yang-Jun Kang, Changwon-shi (KR); Young-Hoan Jeon, Changwon-shi (KR)

(73) Assignee: LG Electronics Inc., Seoul (KR)

( * ) Notice: Subject to any disclaimer, the term of this patent is extended or adjusted under 35 U.S.C. 154(b) by 219 days.

(21) Appl. No.: 12/739,430

(22) PCT Filed: Oct. 9, 2008

(86) PCT No.: PCT/KR2008/005950

§ 371 (c)(1),
(2), (4) Date: Jun. 24, 2010

(87) PCT Pub. No.: WO2009/054629

PCT Pub. Date: Apr. 30, 2009

(65) Prior Publication Data

US 2010/0266429 A1 Oct. 21, 2010

(30) Foreign Application Priority Data

Oct. 24, 2007 (KR) ..... 10-2007-0107349
Oct. 24, 2007 (KR) ..... 10-2007-0107355

(51) Int. Cl.
*F04B 17/04* (2006.01)

(52) U.S. Cl. ..... 417/416; 92/130 C; 92/130 D

(58) Field of Classification Search ..... 417/415; 92/130 C, 130 D

See application file for complete search history.

(56) References Cited

U.S. PATENT DOCUMENTS

| | | | | |
|---|---|---|---|---|
| 3,325,085 | A * | 6/1967 | Gaus | 417/416 |
| 6,174,141 | B1 * | 1/2001 | Song et al. | 417/312 |
| 6,413,057 | B1 * | 7/2002 | Hong et al. | 417/416 |

FOREIGN PATENT DOCUMENTS

| | | |
|---|---|---|
| CN | 1103870 | 6/1995 |
| CN | 1285471 | 2/2001 |
| DE | 1503416 | 1/1970 |
| DE | 102005005698 | 5/2006 |

OTHER PUBLICATIONS

Chinese Office Action dated Jun. 21, 2011 (Application No. 200880112537.X).

International Search Report issued in PCT/KR2008/005950 dated Feb. 6, 2009.

* cited by examiner

*Primary Examiner* — Charles Freay
*Assistant Examiner* — Patrick Hamo
(74) *Attorney, Agent, or Firm* — KED & Associates, LLP

(57) ABSTRACT

A linear compressor is provided in which a resonance frequency may be synchronized with an operating frequency. The linear compressor may include a fixed member including a cylinder, a movable member including a piston for compressing refrigerant in the cylinder, a center portion that coincides with the center of the piston, and a support that extends in a radial direction of the piston and linearly reciprocates about the fixed member, a plurality of front mainsprings arranged symmetrically about the center of the piston and each having one end supported on a front side of the support of the supporter and the other end supported on the fixed member, a single rear mainspring having one end supported on a rear side of the supporter and the other end supported on the fixed member, and a plurality of mass members coupled to a rear side of the supporter at a predetermined distance from the outer diameter of the rear mainspring.

19 Claims, 11 Drawing Sheets

[Fig. 1]
Prior Art
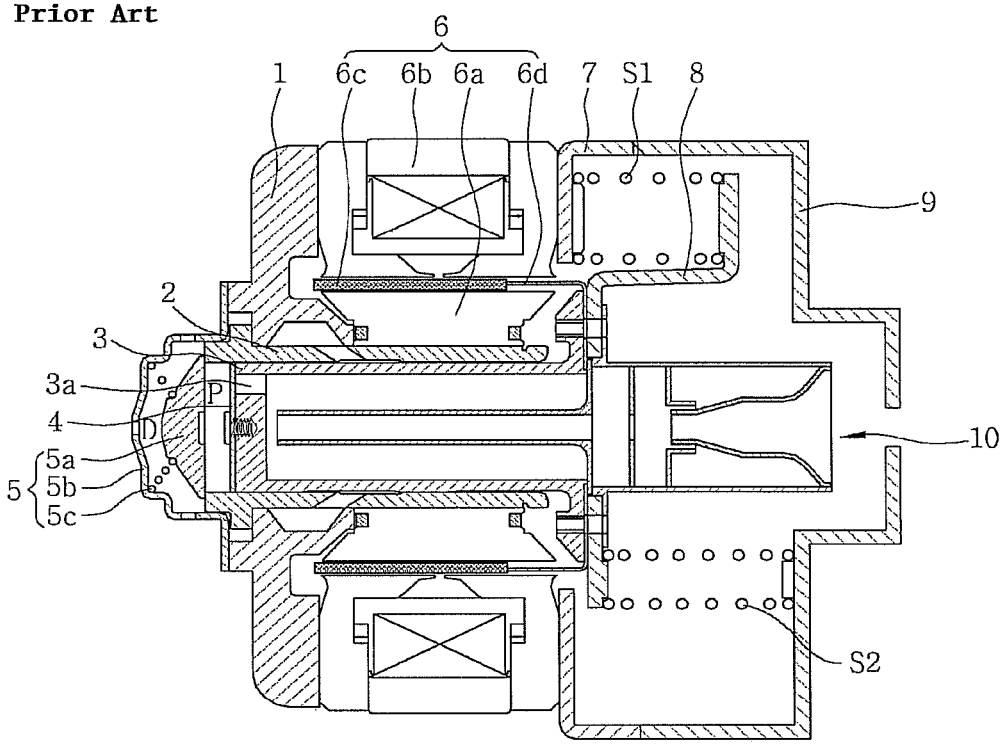
[Fig. 2]
Prior Art
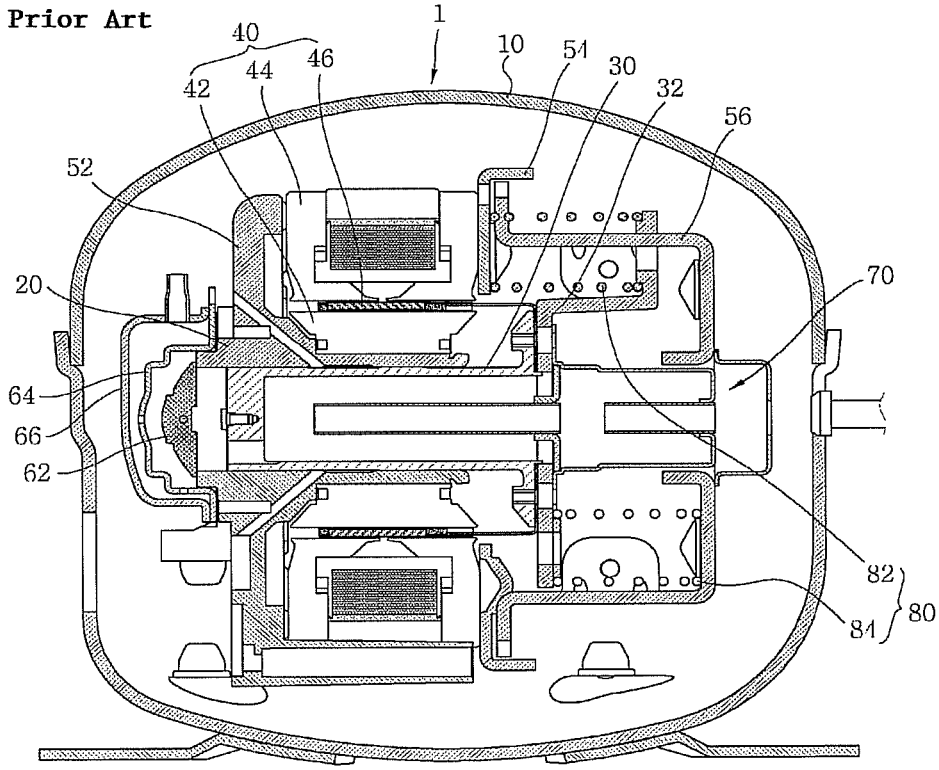

[Fig. 3]
Prior Art
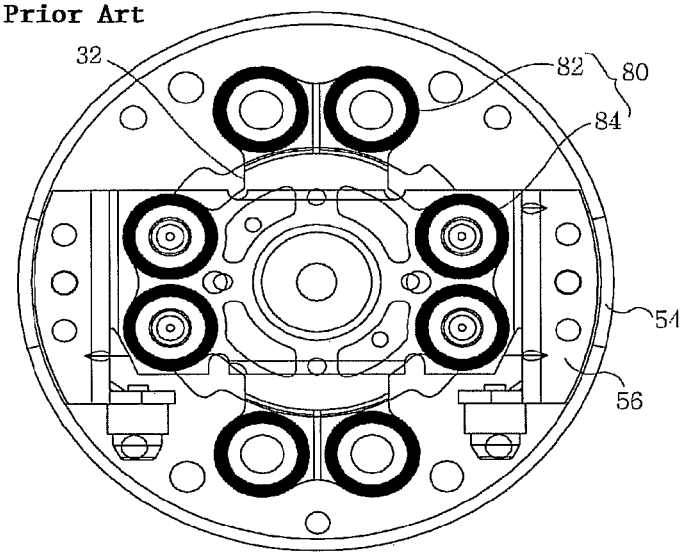
[Fig. 4]
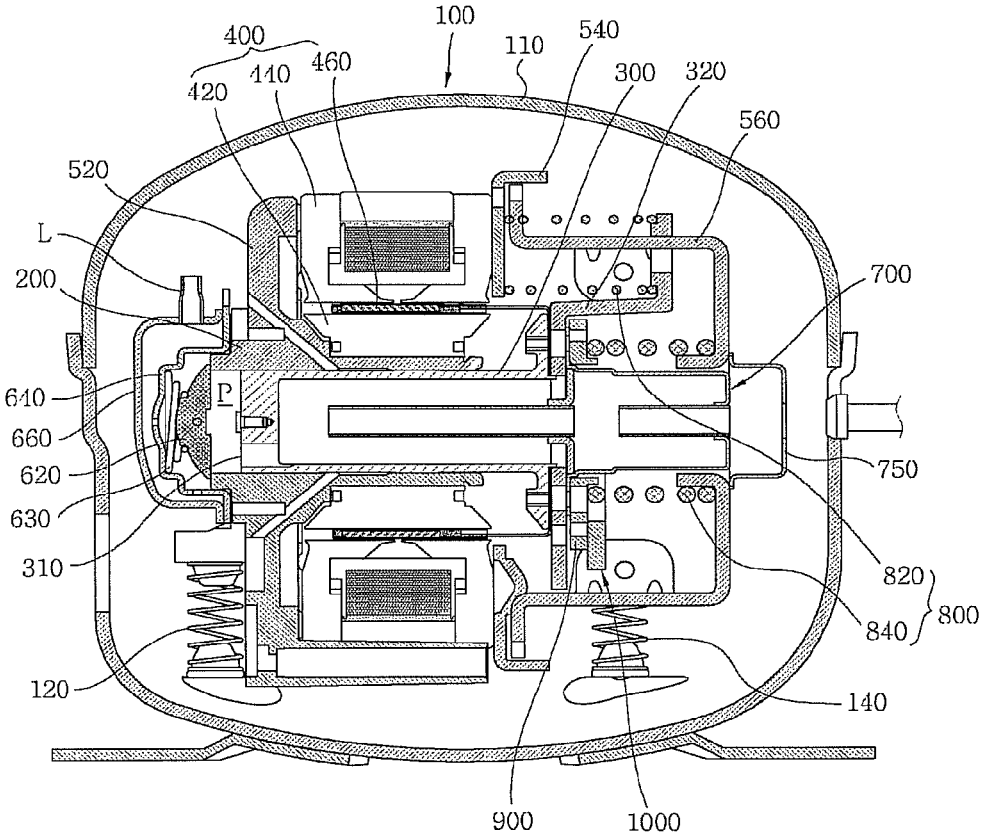

[Fig. 5]
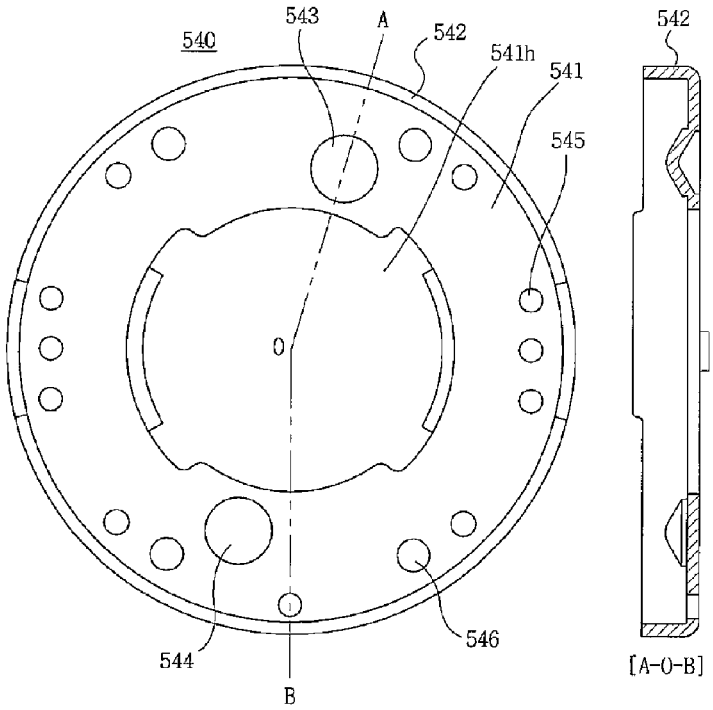
[Fig. 6]
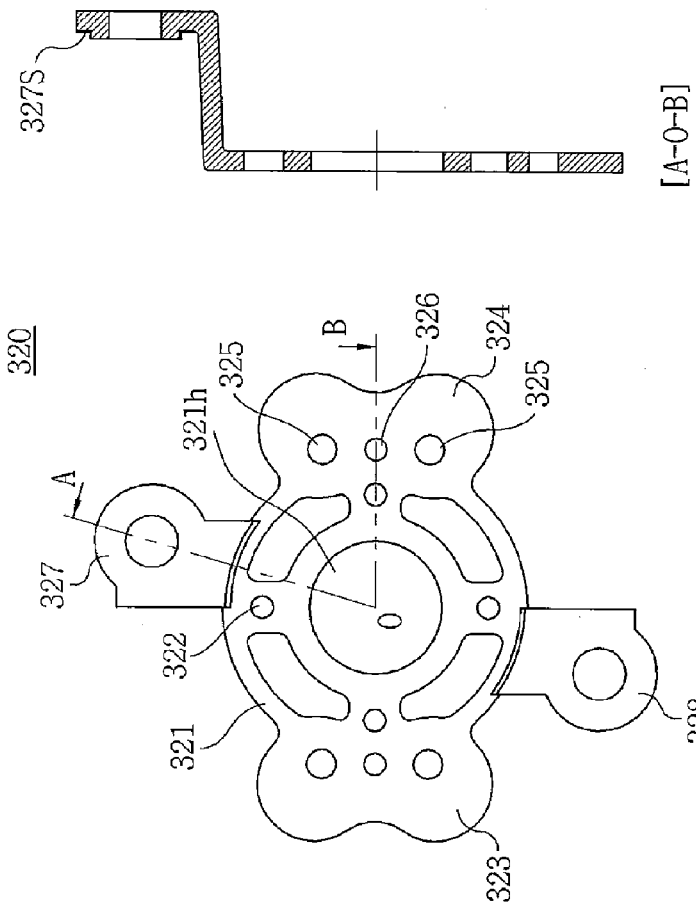

[Fig. 7]
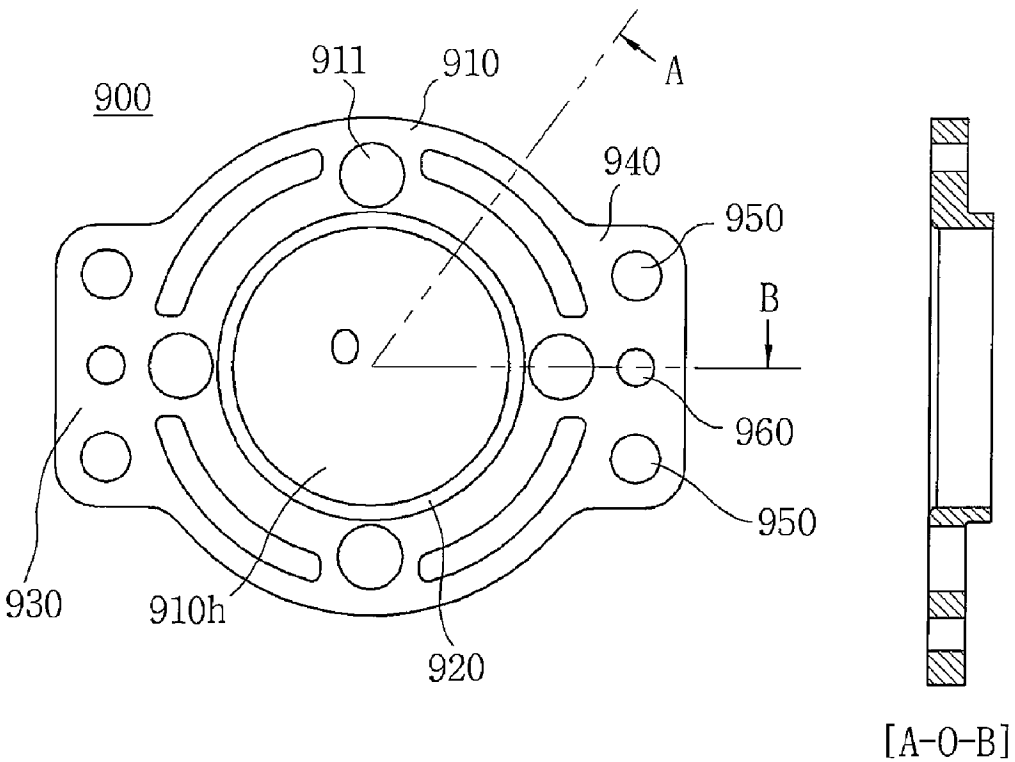
[Fig. 8]
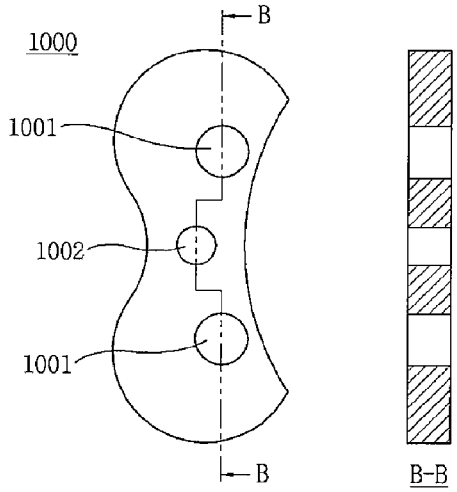

[Fig. 9]
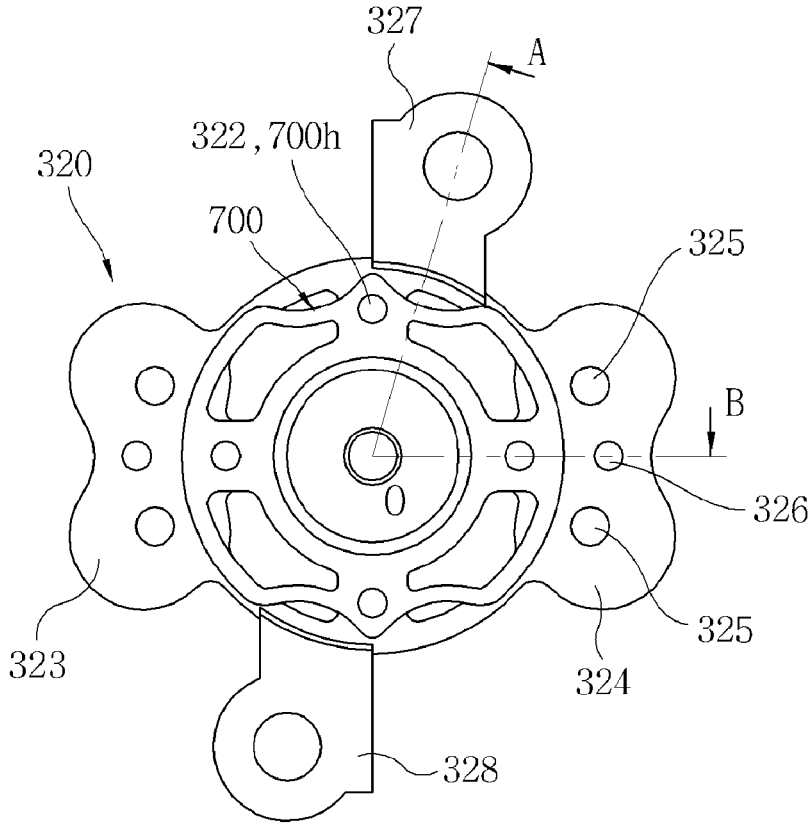
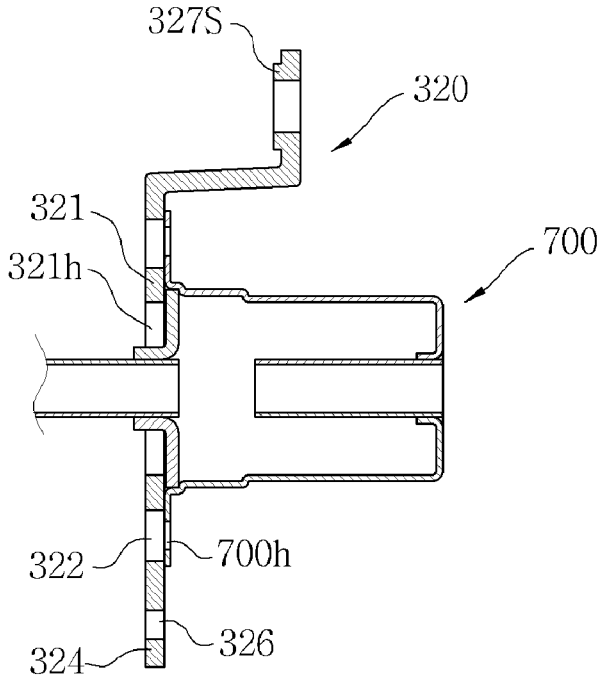
A-O-B

[Fig. 10]
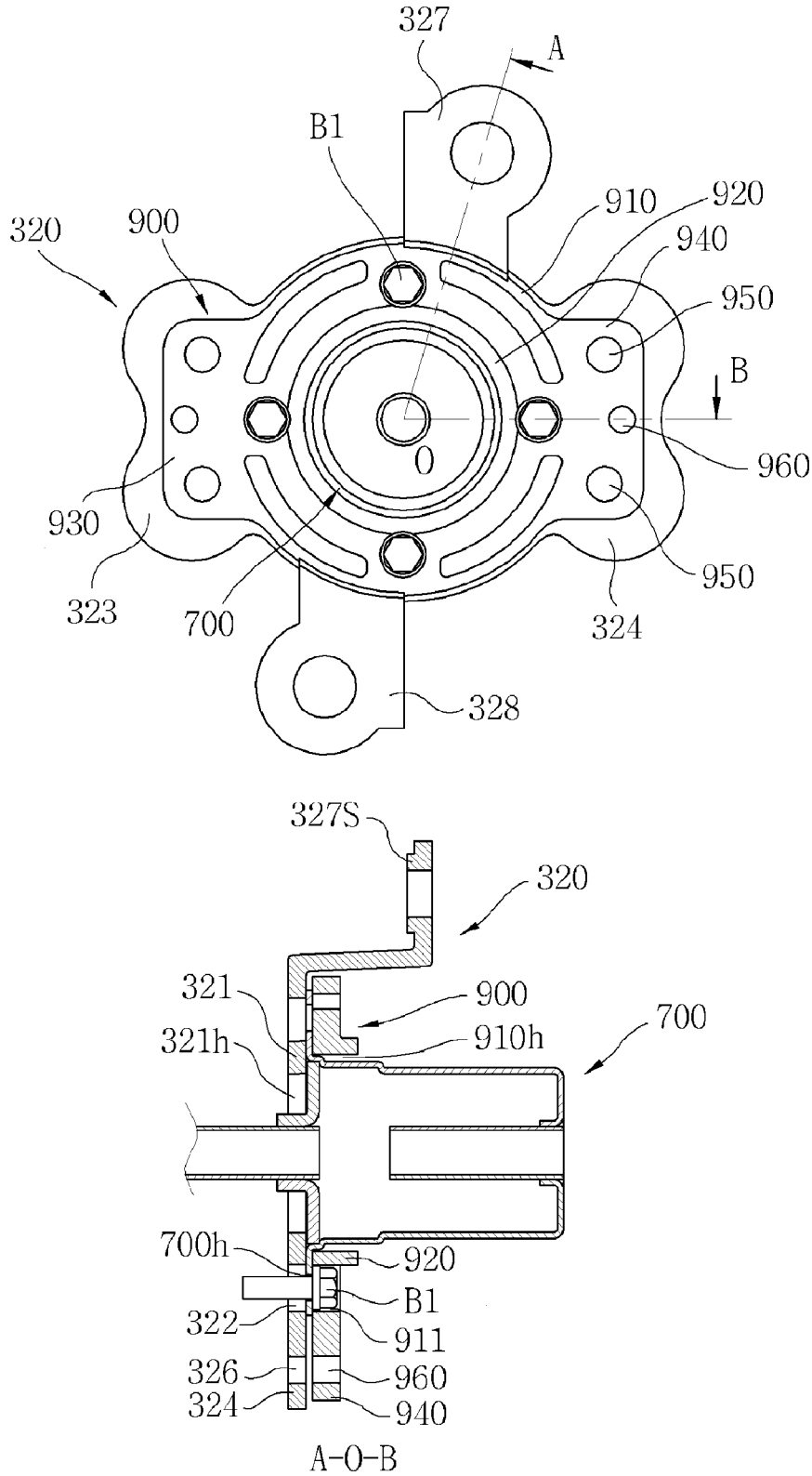

[Fig. 11]
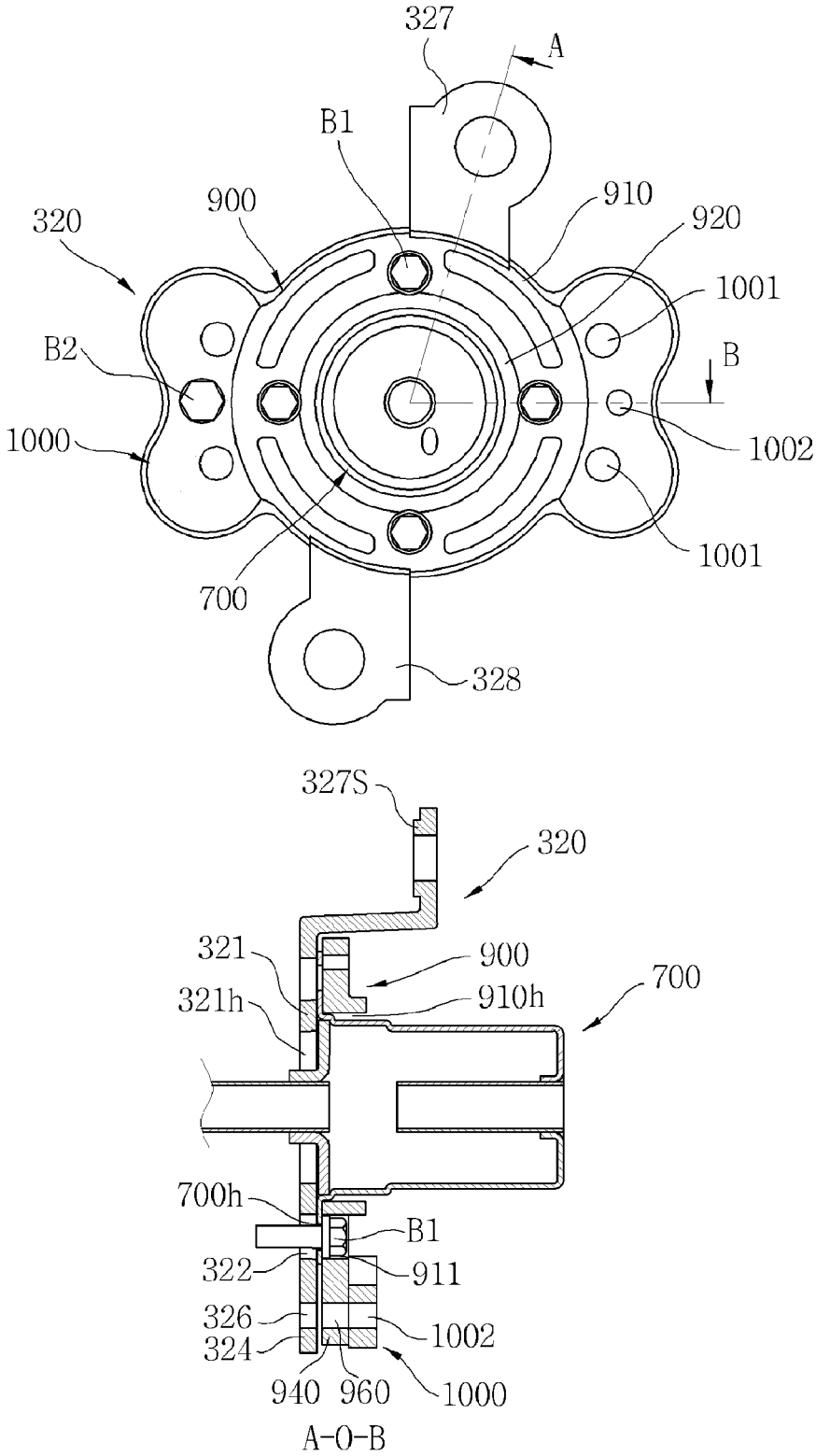

[Fig. 12]
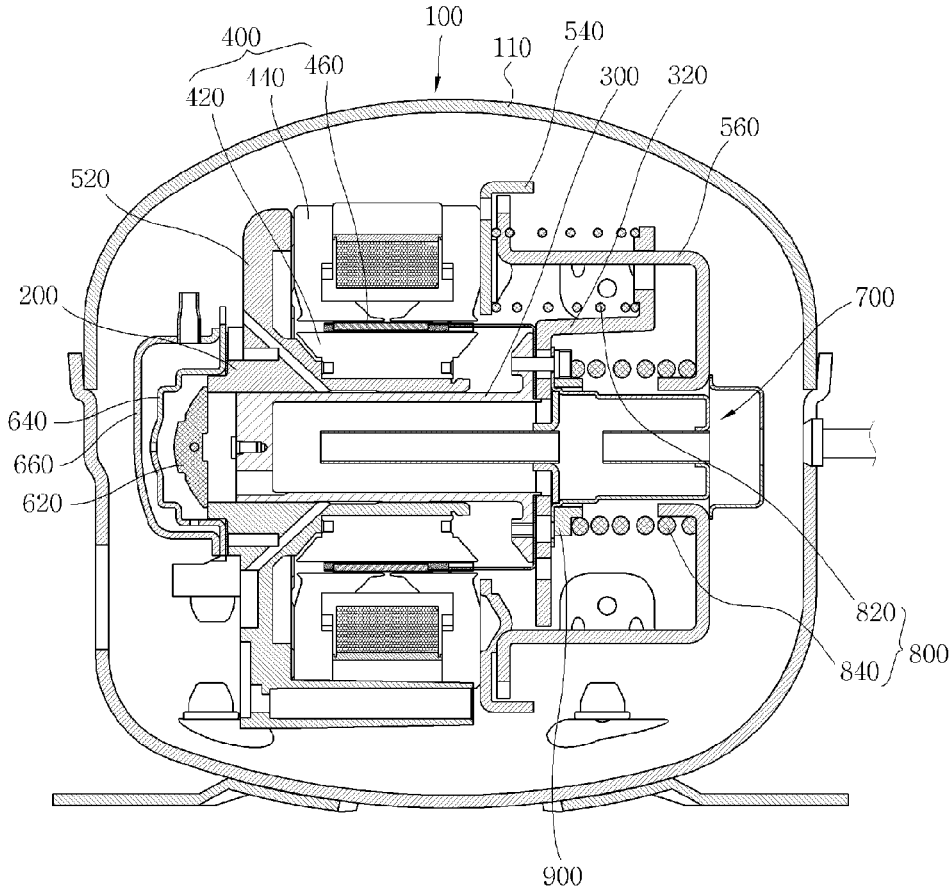
[Fig. 13]
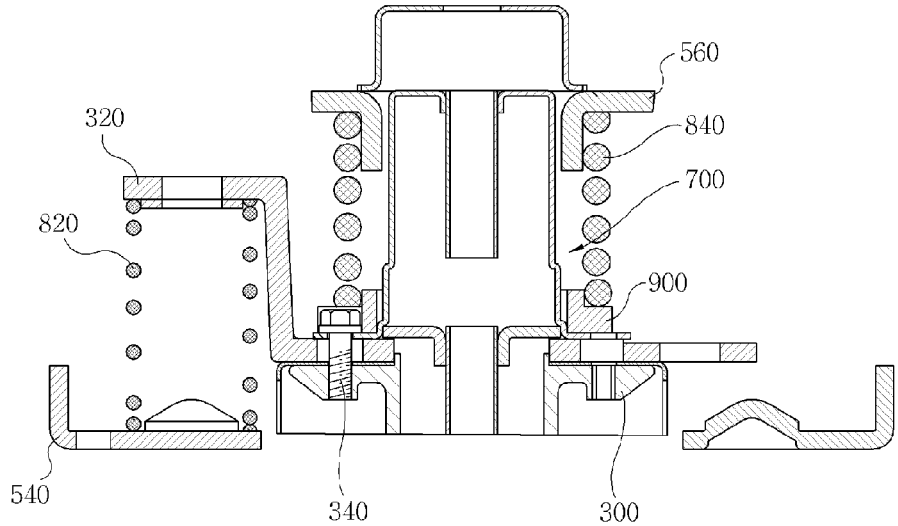

[Fig. 14]
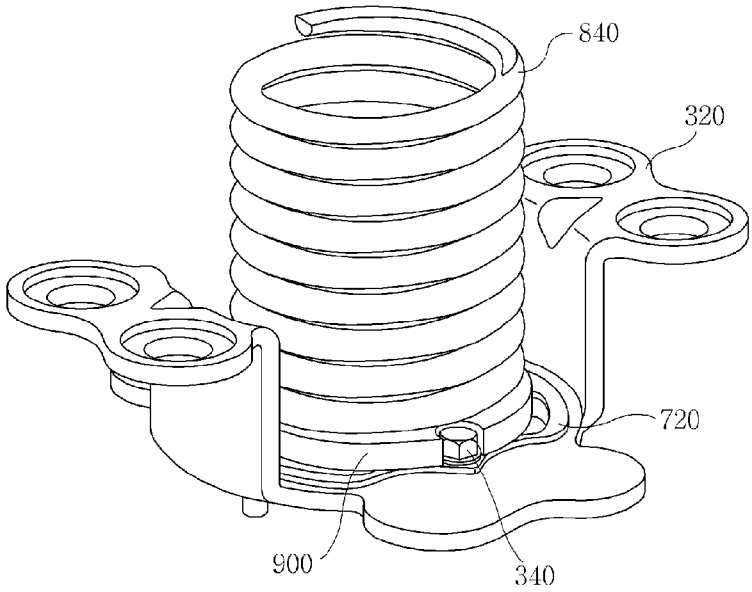
[Fig. 15]
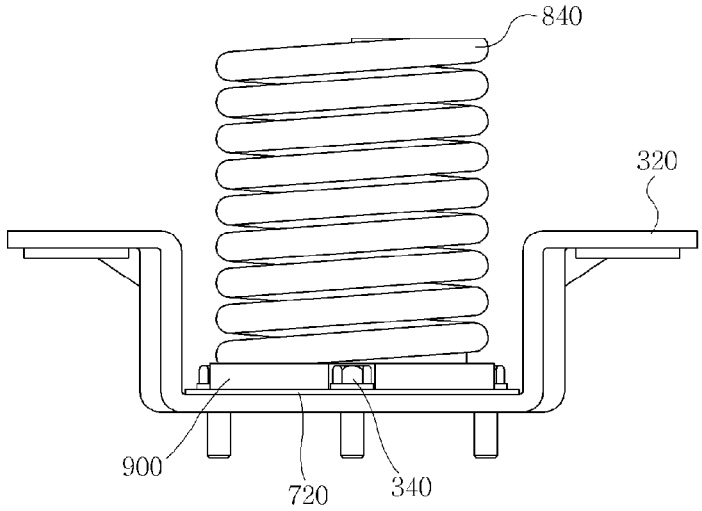
[Fig. 16]
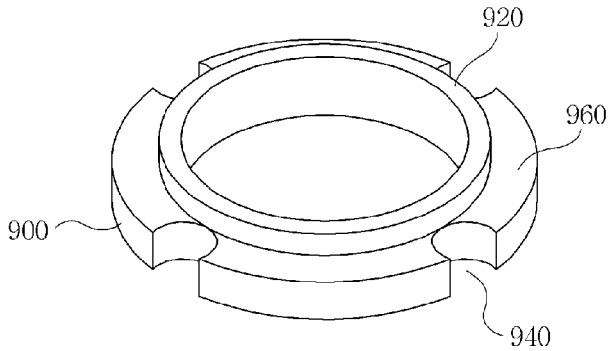

[Fig. 17]
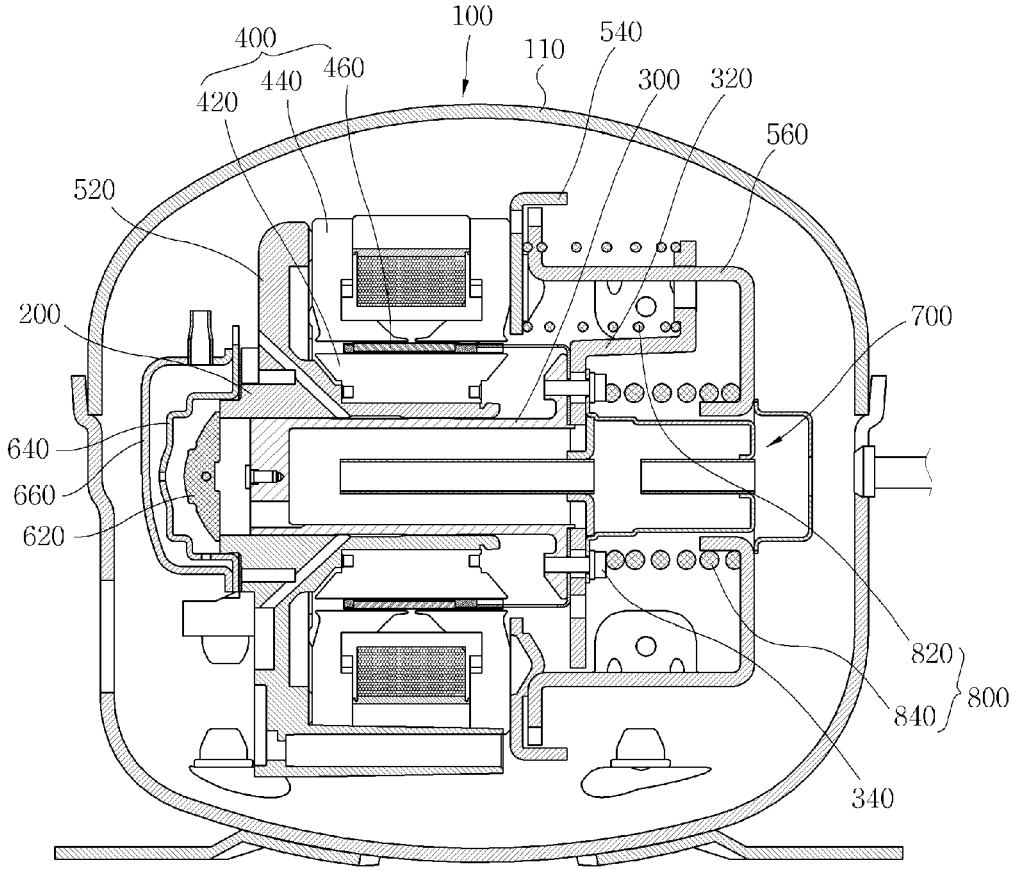
[Fig. 18]
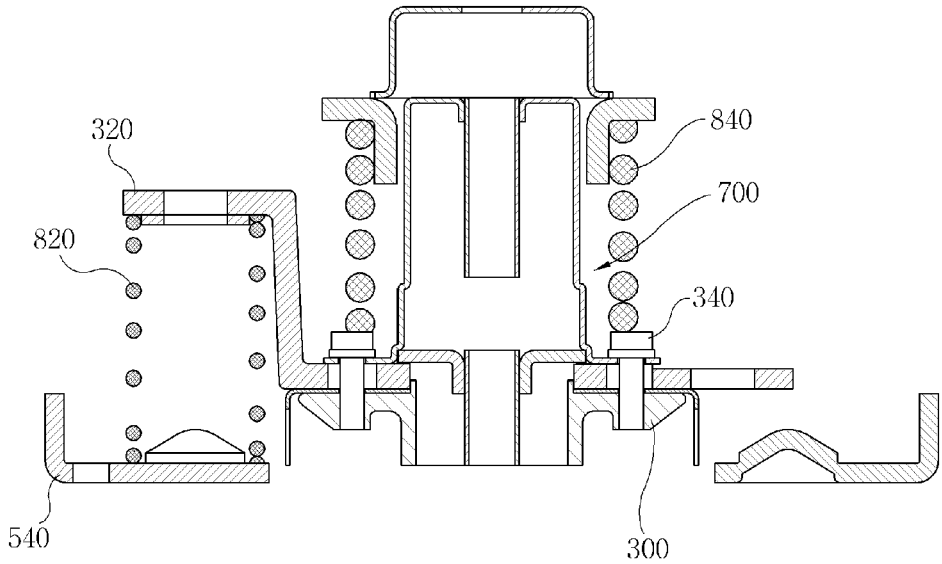

[Fig. 19]
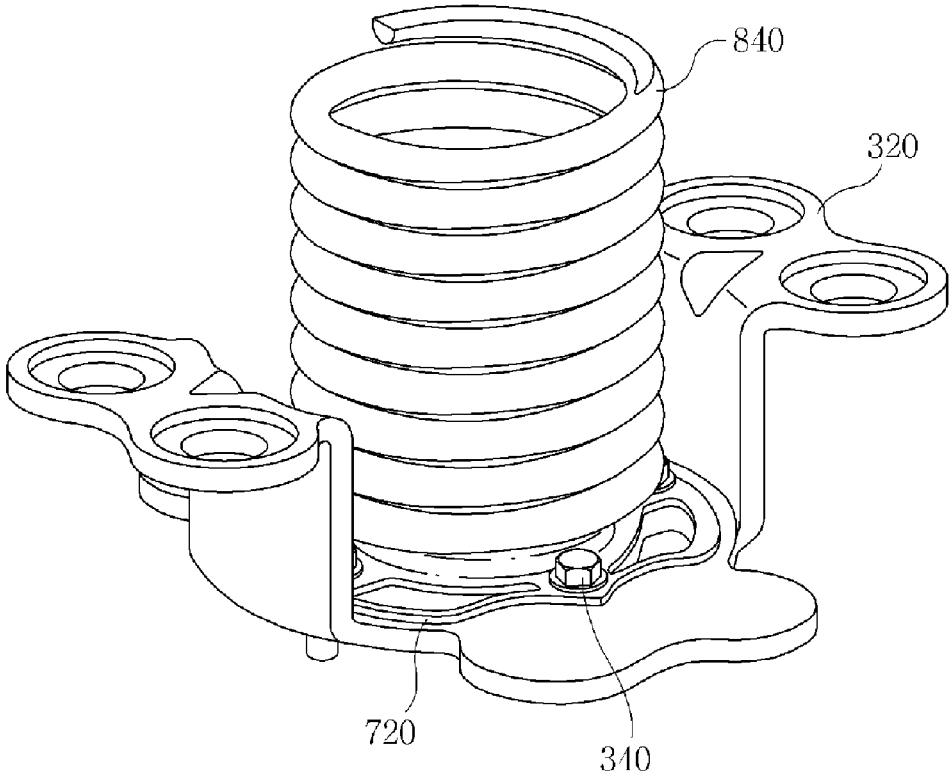
[Fig. 20]
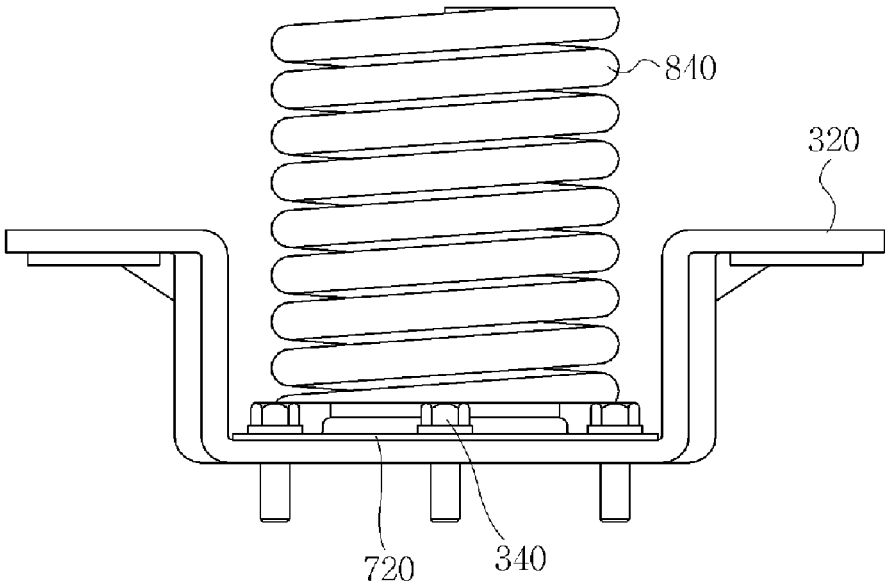

LINEAR COMPRESSOR

TECHNICAL FIELD

The present invention relates in general to a linear compressor, and more particularly, to a linear compressor provided with three mainsprings having a resonance frequency synchronized with an operating frequency, where the resonance frequency can be adjusted without varying initial positions of mainsprings although an additional mass member may be added.

Further, the present invention relates to a linear compressor, which is provided with three mainsprings having a resonance frequency synchronized with an operating frequency of the linear compressor and a rear mainspring installed in a stable manner.

BACKGROUND ART

In general, a reciprocating compressor is designed to form a compression space to/from which an operation gas is sucked/discharged between a piston and cylinder, and the piston linearly reciprocates inside the cylinder to compress refrigerants.

Most reciprocating compressors today has a component like a crankshaft to convert a rotation force of a drive motor into a linear reciprocating drive force for the piston, but a problem arises in a great mechanical loss by such motion conversion. This explains why so many linear compressors are being developed.

Linear compressors have a piston that is connected directly to a linearly reciprocating linear motor, so there is no mechanical loss by the motion conversion, thereby not only enhancing compression efficiency but also simplifying the overall structure. Moreover, since their operation is controlled by controlling an input power to a linear motor, they are much less noisy as compared to other compressors, which is why linear compressors are widely used in indoor home appliances such as a refrigerator.

FIG. 1 illustrates one example of a linear compressor in accordance with a prior art. The conventional linear compressor has an elastically supported structure inside a shell (not shown), the structure including a frame 1, a cylinder 2, a piston 3, a suction valve 4, a discharge valve assembly 5, a linear motor 6, a motor cover 7, a supporter 8, a body cover 9, mainsprings S1 and S2, a muffler assembly 10, and an oil feeder 20.

The cylinder 2 is insertedly fixed to the frame 1, and the discharge assembly 5 constituted by a discharge valve 5*a*, a discharge cap 5*b*, and a discharge valve spring 5*c* is installed to cover one end of the cylinder 2. The piston 3 is inserted into the cylinder 2, and the suction valve 4 which is very thin is installed to open or close a suction port 3*a* of the piston 2.

The linear motor 6 is installed in a manner that a permanent magnet 6*c* linearly reciprocates while maintaining the air-gap between an inner stator 6*a* and an outer stator 6*b*. To be more specific, the permanent magnet 6*c* is connected to the piston 3 with a connecting member 6*d*, and an interactive electromagnetic force between the inner stator 6*a*, the outer stator 6*b*, and the permanent magnet 6*c* makes the permanent magnet 6*c* linearly reciprocating to actuate the piston 3.

The motor cover 7 supports the outer stator 6*b* in an axial direction to fix the outer stator 6*b* and is bolted to the frame 1. The body cover 9 is coupled to the motor cover 7, and between the motor cover 7 and the body cover 9 there is the supporter 8 that is connected to the other end of the piston 3, while being elastically supported in an axial direction by the mainsprings S1 and S2. The muffler assembly 10 for sucking in refrigerant is also fastened to the supporter 8.

Here, the mainsprings S1 and S2 consist of four front springs S1 and four rear springs S2 that are arranged in horizontally and vertically symmetrical positions about the supporter 8. As the linear motor 6 starts running, the front springs S1 and the rear springs S2 move in opposite directions and buff the piston 3 and the supporter 8. In addition to these springs, the refrigerant in the compression space P functions as sort of a gas spring to buff the piston 3 and the supporter 8.

Therefore, when the linear motor 6 starts running, the piston and the muffler assembly 10 connected to it move in a linear reciprocating direction, and with the varying pressure in the compression space P the operation of the suction valve 4 and the discharge valve assembly 5 are automatically regulated. Under this mechanism, the refrigerant flows via a suction pipe on the side of the shell, an opening of the body cover 9, the muffler assembly 10, and suction ports 3*a* of the piston 3 until it is sucked in the compression space P and compressed. The compressed refrigerant then escapes to the outside through the discharge cap 5*b*, the loop pipe and an outlet duct on the side of the shell.

Having as many as eight mainsprings S1 and S2, the linear compressor is now faced not only with a large number of springs but also with many variables that need to be controlled to stay balanced during the motion (e.g., pumping stroke) of the piston 3. These pose certain problems such as complicated and lengthy manufacturing process and increased manufacturing costs.

Moreover, the conventional linear compressor is designed in such a way that its resonance frequency is synchronized with an operating frequency of the linear motor 6 to increase compression efficiency. Here, the resonance frequency varies by many factors, e.g., stiffness of the mainsprings S1 and S2, stiffness of a gas spring, a total mass of immovable members including a cylinder (hereinafter, they are referred to as fixed members), and a total of mass of members that are operationally coupled with the piston 3 (hereinafter, they are referred to as movable members), so one can easily synchronize the resonance frequency with the operating frequency, simply by increasing the mass of the movable member. One typical way to increase the mass to the movable member is to fasten a mass member (not shown) to the piston 3 and the connecting member 6*d* on the side of the supporter 8, but because of the newly added mass member, initial positions of the front and rear springs S1 and S2 shift and so does the initial position of the piston 3 with respect to the cylinder 2. In result, volume of the compression space changes, thereby changing stiffness of the gas spring at the same time. That is, when someone changes a total mass of the movable member trying to synchronize the resonance frequency with the operating frequency, wanted or not, stiffness of the gas spring varies and this in turn makes it hard to synchronize the resonance frequency with the operating frequency. Therefore, a problem situation is created where it is difficult to manage running conditions of the linear compressor as efficiently as possible, the compression efficiency is degraded, the manufacturing process becomes more complicated as additional changes have to be made in design, and the shorter stroke length of the piston 3 also impairs an overall compression efficiency.

FIG. 2 is a side sectional view of a conventional linear compressor, and FIG. 3 is a longitudinal sectional view of FIG. 2.

Referring to FIG. 2, a conventional linear compressor 1 is configured that inside a hermetic shell 10, a piston 30, which is driven by a linear motor 40, linearly reciprocates inside a cylinder 20 to suck in, compress and discharge refrigerant.

The linear motor 40 includes an inner stator 42, an outer stator 44, and a permanent magnet 46 positioned between the inner stator 42 and the outer stator 44. Here, the permanent magnet 46 is driven by an interactive electromagnetic force to make a linear reciprocating motion. As the permanent magnet 46 moves while being connected to the piston 30, the piston 30 also makes a linear reciprocating motion inside the cylinder 20, thereby sucking in, compressing and discharging refrigerant.

The linear compressor 1 further includes a frame 52, a stator cover 54, and a back cover 56. For the linear compressor, the cylinder 20 may be fastened to the frame 52, or the cylinder 20 and the frame 52 may be integrately formed as well. In front of the cylinder 20, there is a discharge valve 62 which is elastically supported by an elastic member and goes to an open position or to a closed position selectively by pressure of the refrigerant inside the cylinder 20. Moreover, a discharge cap 64 and a discharge muffler 66 which are seated in front of the discharge valve 62 are fastened to the frame 52. One end of the inner stator 42 and one end of the outer stator 44 are also supported on the frame 52. The other end of the inner stator 42 is supported by a separate member such as an O-ring or by a fixed jaw on the cylinder 20, while the other end of the outer stator 44 is supported by the stator cover 54. The back cover 56 is seated on the stator cover 54, and a suction muffler 70 is placed between the back cover 56 and the stator cover 54.

The supporter 32 is coupled to the rear side of the piston 30. The supporter 32 is provided with mainsprings 80, each mainspring having a natural frequency to help the piston 30 resonate. The mainsprings 80 are divided into front springs 82 both ends of which are supported on the supporter 32 and the stator cover, respectively; and rear springs 84 both ends of which are supported on the supporter 32 and the back cover 56, respectively.

FIG. 3 illustrates that four front springs 82 and four rear springs 84 are arranged facing each other. To be more specific, the front springs 82 have two springs on the top and two springs on the bottom, facing each other; and the rear springs 84 have two springs on the left side and two springs on the right side, facing each other. The front springs 82 are supportably mounted between the supporter 32 and the stator cover 54, and the rear springs 84 are supportably mounted between the supporter 32 and the back cover 56.

As discussed earlier, having a large number of mainsprings 80 means that there are going to be a lot of position variables to be controlled to stay balanced during the motion of the piston 30. Because of that, an overall manufacturing process gets complicated and lengthy, and manufacturing costs are high.

Meanwhile, if the suction muffler 70 is secured to the supporter 32 by means of a fastening member, no escape structure is provided for the fastening member. This actually causes an unnecessary interference or friction of the mainsprings to give rise to problems like noise and damages on the mainsprings. Therefore, there is a need to develop a way out for an elaborate elastic motion of the mainsprings.

DISCLOSURE OF INVENTION

Technical Problem

The present invention is conceived to solve the aforementioned problems in the prior art. An object of the present invention is to provide a linear compressor featuring less use of mainsprings.

Another object of the present invention is to provide a linear compressor having a movable member to linearly reciprocate by a linear motor while being supported by mainsprings, in which the mainsprings remain at their initial positions even after mass members were added to the movable member.

A further object of the present invention is to provide a linear compressor having two mainsprings and one rear mainspring, and the rear mainspring is settled stably in a holder that has a plurality of cavities, each of which creates an escape structure for a fastening bolt.

Technical Solution

According to an aspect of the present invention, there is provided a

A linear compressor, comprising: a fixed member, which includes a cylinder for providing a refrigerant compression space; a movable member, which includes a piston for compressing refrigerant inside the cylinder, a center portion, and a support extended from the center portion in a radial direction of the piston, and which makes a linear reciprocating motion about the fixed member; a plurality of front mainsprings, each of which has one end being supported on a front side of the support of the supporter and the other end being supported on the fixed member, and which are located symmetrically about the piston; a single rear mainspring, which has one end being supported on a rear side of the support of the supporter and the other end being supported on the fixed member; and a plurality of mass members coupled to a rear side of the supporter, having a predetermined distance from the outer diameter of the rear mainspring. In order to vary a resonance frequency that is dependent on stiffness of mechanical springs, stiffness of a gas spring, and mass of mass members, mass members are added to the piston to increase a total mass of the piston, and the mass members are located in carefully defined installation positions not to displace the mechanical springs from their initial positions, thereby exerting no influence on the stiffness of a gas spring and further achieving an accurate resonance design.

In one embodiment, the mass members are coupled symmetrically about the center portion of the supporter. Therefore, although mass members are added to the piston, mass unbalance can be controlled during the pumping stroke of the piston, which leads to a stable performance of the linear compressor.

In one embodiment, the linear compressor further comprises a spring guider positioned between the supporter and the rear mainspring, for supporting one end of the rear mainspring.

In one embodiment, the spring guider is installed at the rear side of the center portion of the supporter to be positioned between the supporter and the rear mainspring, and the mass members are coupled to the spring guider symmetrically about the center portion of the spring guider. In the presence of the spring guider, therefore, the single rear mainspring is supported more stably. Moreover, even if the spring guider and mass members are added to the piston, mass unbalance is controlled during the pumping stroke of the piston, thereby enabling a stable performance of the linear compressor.

In one embodiment, the linear compressor further comprises a suction muffler positioned inside the piston and the rear mainspring, for introducing refrigerant into the piston, and an extended portion of the suction muffler, the spring guider, and the mass members are fastened in order to the rear side of the supporter. Although other components besides the mass members may be added to the piston, a stable fastened state is maintained by fastening the components twice.

Another aspect of the present invention provides a linear compressor, comprising: a fixed member, which includes a cylinder for providing a refrigerant compression space; a movable member, which includes and a supporter having a center portion that coincides with the center of the piston and an extended portion that is connected to the piston and extended in a radial direction of the piston, and which makes a linear reciprocating motion about the fixed member; a plurality of front mainsprings, each of which has one end being supported on a front side of the support of the supporter and the other end being supported on the fixed member, and which are located symmetrically about the center of the piston and the center of the supporter; a single rear mainspring, which has one end being supported on the supporter, and which is positioned on a different side from the piston; a suction muffler, which linearly reciprocates engagedly with the movable member to provide a passage for introducing refrigerant, and which reduces noise; and a spring guider positioned between the supporter and the rear mainspring, which supports one end of the rear mainspring and which has a plurality of cavities on the circumference.

In one embodiment, the spring guider includes a holder which contacts at least the rear mainspring and which has a greater hardness than that of the rear mainspring.

In one embodiment, the spring guider has a stepped portion into which one end of the rear mainspring is insertedly fitted.

Advantageous Effects

The present invention linear compressor with the configuration described above is characterized in that its linearly-reciprocating movable member is elastically supported on both sides by plural front mainsprings and one single rear mainspring. That is, the number of mainsprings used for the linear compressor has been reduced, thereby contributing to a reduction in an overall cost of part production and to a simplified installation procedure.

In the linear compressor of the present invention, the linearly reciprocating movable member with separate mass members added thereto is installed at a predetermined distance away from the outer diameter of the mainsprings not to be interfered/overlapped with them. Therefore, although mass members may have been added to the movable member, the mainsprings would not displace from their initial positions. Now that a resonance frequency is easily synchronized with an operating frequency of the linear motor, running conditions of the linear compressor can be managed as efficiently as possible, inconveniences in additional changes/modifications in design for synchronization of the resonance frequency with the operating frequency are reduced, and stroke length of the piston can be increased to enhance the compression efficiency.

Moreover, the spring guider of the linear compressor has a holder with cavities each of which provides as an escape structure to a fastening bolt, so the rear mainspring can be settled in a stable manner.

BRIEF DESCRIPTION OF THE DRAWINGS

FIG. 1 illustrates one example of a linear compressor in accordance with a prior art;

FIG. 2 illustrates a conventional linear compressor;

FIG. 3 is a longitudinal sectional view of FIG. 2;

FIG. 4 illustrates a linear compressor in accordance with one embodiment of the present invention;

FIG. 5 illustrates one example of a motor cover adapted to FIG. 4;

FIG. 6 illustrates one example of a supporter adapted to FIG. 4;

FIG. 7 illustrates one example of a spring guider adapted to FIG. 4;

FIG. 8 illustrates one example of mass members being adapted to FIG. 4;

FIGS. 9 through 11 diagrammatically illustrate the assembly sequence of a movable member in a linear compressor in accordance with the present invention;

FIG. 12 illustrates a linear compressor in accordance with the present invention;

FIG. 13 illustrates a mainspring section in a linear compressor in accordance with the present invention;

FIG. 14 illustrates a rear mainspring section in a linear compressor in accordance with the present invention;

FIG. 15 is a front view of FIG. 14;

FIG. 16 illustrates a spring guider in a linear compressor in accordance with the present invention;

FIG. 17 illustrates a comparative example of a linear compressor without a spring guide;

FIG. 18 illustrates a comparative example of a mainspring section without a spring guider;

FIG. 19 illustrates a comparative example of a rear mainspring section without a spring guider; and FIG. 20 is a front view of FIG. 19.

MODE FOR THE INVENTION

Hereinafter, preferred embodiments of the present invention will be described in detail with reference to the accompanying drawings.

FIG. 4 illustrates a linear compressor in accordance with one embodiment of the present invention. One embodiment of a linear compressor

100 in accordance with the present invention includes a cylinder 200, a piston 300, a linear motor 400 provided with an inner stator 420, an outer stator 440, and a permanent magnet 460, and mass members 1000, each being housed in a shell 110 serving as a hermetic casing. When the permanent magnet 460 linearly reciprocates by an interactive electromagnetic force between the inner stator 420 and the outer stator 440, the piston 300 connected to the permanent magnet 460 engagedly moves along the permanent magnet 460, making a linear reciprocating motion.

The inner stator 420 is affixed to an outer periphery of the cylinder 200, and the outer stator 440 is secured axially by a frame 520 and a motor cover 540. The frame 520 and the motor cover 540 are joined together by fastening members such as bolts, and the outer stator 440 is secured between the frame 520 and the motor cover 540. The frame 520 may be integrately formed with the cylinder 200, or the frame 520 may be manufactured separately and then coupled to the cylinder 200 later. The embodiment in FIG. 4 shows an example where the frame 520 and the cylinder 200 are integrated as one body.

The supporter 320 is connected to the rear side of the piston 300. Two front mainsprings 820 are supported on both ends by the supporter 320 and the motor cover 540. Also, one rear mainspring 840 is supported on both ends by the supporter 320 and a back cover 560, and the back cover 560 is coupled to the rear side of the motor cover 540. The supporter 320 is provided with a spring guider 900, so as to prevent abrasion of the supporter 320 and to increase the supporting strength of the rear mainspring 840. Besides supporting the rear mainspring 840, the spring guider 900 also guides the rear mainspring 840 to be concentric with the piston 300. A suction muffler 700 is provided to the rear side of the piston 300, through which refrigerant flows into the piston 300, so less noise is generated during suction feeding. To be more specific, the suction muffler 700 is positioned inside the rear mainspring 840.

The interior of the piston 300 is hollowed to let the refrigerant which is fed through the suction muffler 700 introduced and compressed in a compression space P defined between the cylinder 200 and the piston 300. A suction valve 310 seats at the front end of the piston 300. The suction valve 310 in the open position allows the refrigerant to flow from the piston 300 into the compression space P, and it shuts the front end of the piston 300 to prevent backflow of the refrigerant from the compression space P to the piston 300.

When refrigerant inside the compression space P is compressed to a predetermined level or higher, it causes a discharge valve 620 which is seated at the front end of the cylinder 200 to open. The discharge valve 620 is elastically supported by a spiral discharge valve spring 630 inside a support cap 640 that is secured to one end of the cylinder 200. The high-pressure compressed refrigerant is then discharged into a discharge cap 660 via a hole which is formed in the support cap 640, and then escapes from the linear compressor 110 via a loop pipe L to be circulated, thereby making the refrigeration cycle work.

All of the components of the linear compressor 100 described above are supported by front and rear support springs 120 and 140 in assembled state, and stay at a certain distance away from the bottom of the shell 110. Since they are not in direct contact with the bottom of the shell 110, the shell 110 is free from the influence of vibrations that are produced by each component of the compressor 100 when compressing refrigerant. As a result, less vibration is delivered to the outside of the shell 110 and therefore, less noise is created due to the vibration of the shell 110.

The linear compressor 100 is constituted by fixed members that are immovable such as the cylinder 200, and movable members that include the piston 300, making a linear reciprocating motion. Meanwhile, a resonance system is designed in such a way that a resonance frequency (fm) of the system synchronizes with an operation frequency (fo) of the linear motor 400. Although the resonance frequency of the system may vary depending on front/rear support springs 120 and 140, front/rear mainsprings 820 and 840, gas spring, fixed member, and movable member, the influences of the front/rear support springs 120 and 140 may be neglected considering their linear reciprocating motion in an axial direction.

$$fm = \frac{1}{2\pi}\sqrt{\frac{(K_m + K_g)}{\left(\frac{M_s M_m}{Ms + M_m}\right)}} \qquad \text{[Equation]}$$

As one can see from the Equation, the resonance frequency (fm) of the system varies by stiffness (Km) of the front/rear mainsprings 820 and 840, stiffness (Kg) of the gas spring, mass (Ms) of the fixed member, and mass (Mm) of the variable member. Although mass (Ms) of the fixed member is a given constant, stiffness (Km) of the front/rear mainsprings 820 and 840 has a somewhat dispersion and stiffness (Ks) of the gas spring also varies according to the initial positions of the front/rear mainsprings 820 and 840 and the load condition(s). Thus, one should synchronize the resonance frequency (fm) of the system with an operating frequency (fo) of the linear motor, while altering the mass (Mm) of the movable member by adding a predetermined number of mass members 1000 to the movable member. In order for the front/rear mainsprings 820 and 840 to stay at their initial positions, the mass members 1000 are coupled to both sides of the supporter 320 where the sides do not to axially overlap with the front/rear main springs 820 and 840.

FIG. 5 illustrates one example of a motor cover adapted to FIG. 4. A motor cover 540 is a nearly annular body 541, and has a hole 541*h* at the center to let a movable member constituted by a piston 300 (see FIG. 4), a permanent magnet 460 (see FIG. 4), a supporter 320 (see FIG. 4), and a muffler 700 (see FIG. 4) formed in one integrated unit pass through and continue the linear reciprocating motion. Also, a bent portion 542 that is bent rearwardly along the circumference of the motor cover 540 is provided. The bent portion 542 serves to increase the supporting strength of the motor cover 540.

The center of the motor cover 540 coincides with the center of the piston 320 (see FIG. 4), and two rearwardly protruded support protrusions 534 and 544 are formed at positioned corresponding to the center to support the front mainspring 820 (see FIG. 4). The support protrusions 534 and 544, together with the supporter 320 (see FIG. 4) supports both ends of the front mainspring 820 (see FIG. 4). To be more specific, the supporter 320 (see FIG. 4) supports the rear end (one end) of the front mainspring 820 (see FIG. 4), and the support protrusions 534 and 544 support the front end (the other end) of the front mainspring 820 (see FIG. 4).

Moreover, on both sides of the motor cover 540, there are a plurality of bolt holes 545 to receive bolts that are used for fastening the motor cover 540 to the back cover 560 (see FIG. 4), and a plurality of bolt holes 546 to receive bolts that are used for fastening the motor cover 540 to the frame 520.

FIG. 6 illustrates one example of a supporter adapted to FIG. 4. A supporter 320 is coupled to the rear side of the piston 300 (see FIG. 4), and transfers a force from the mainsprings 820 and 840 (see FIG. 4) to the piston 300 (see FIG. 4) to help the piston 300 (see FIG. 4) make a linear reciprocating motion under resonance conditions. The supporter 320 has a plurality of bolt holes 323 through which the supporter 320 and the piston 300 (see FIG. 4) are bolted together.

The supporter 320 is positioned in such a manner that its center coincides with the center of the piston 300 (see FIG. 4). To facilitate the center alignment, the rear end of the piston 300 (see FIG. 4) has a stepped face. The supporter 320 has a nearly annular body 321 which has a hole 321*h* at the center to pass part of the muffler 700 (see FIG. 4), guides 323 and 324 on both sides, and supports 327 and 328 on the top and bottom. Of course, a plurality of bolt holes 322 are formed around the hole 321*h* of the body 321 through which the muffler 700 (FIG. 4) is bolted directly to the rear side of the body 321 of the supporter 320. At this time, the front end of the rear mainspring 840 (see FIG. 4) is supported by the spring guider 900 (see FIG. 4) that is positioned on the rear side of the body 321 of the supporter 320, and the rear end of the rear mainspring 840 (see FIG. 4) is supported on the front side of the back cover 560 (see FIG. 4). The muffler 700 (see FIG. 4) is settled inside the rear mainspring 840 (see FIG. 4).

The guides 323 and 324 of the supporter 320 are expanded portions from the body 321 of the supporter 320 in the lateral direction. The guides 323 and 324 each has two guide holes 325 and one bolt hole 326 between the guide holes 325, where the guide holes 325 are used to align the center of the spring guide 900 (see FIG. 4) with the center of the piston 300 (see FIG. 4) and the bolt holes 326 are used for the bolt joint between the guides and the spring guider 900 (see FIG. 4).

The supports 327 and 328 of the supporter 320 are formed on the top and bottom of the body 321, i.e., being vertically symmetrical about the center of the supporter 320, and are bent twice from the body 321. That is, the supports 327 and 328 are first bent rearwardly from the body 321, and then upwardly and downwardly, respectively, from the rear side. The rear end (one end) of the front mainspring 820 (see FIG. 4) is supported on the front side of the supports 327 and 328 of the supporter 320, and the front end (the other end) of the front mainspring 820 (see FIG. 4) is supported on the rear side of the motor cover 540 (see FIG. 4).

With the use of smaller number of front and rear mainsprings, namely, two front mainsprings 820 (see FIG. 4) and one rear mainspring 840 (see FIG. 4), the overall spring stiffness in the resonance system is weakened. Needless to say, the use of smaller number of front and rear mainsprings contribute to lower manufacturing costs.

As the stiffness of the front and rear mainsprings 820 and 840 (see FIG. 4) are weakened, a total mass of the drive mechanism such as the piston 300 (see FIG. 4), the supporter 320 and the permanent magnet 460 (see FIG. 4) should be reduced in order for the drive mechanism to be able to work under resonance conditions. Because of this, the supporter 320 is made from non-ferrous metals, not ferrous metals, which have relatively lower densities than ferrous metals. In this manner, the mass of the drive mechanism can be reduced, as opposed to the weakened stiffness of the front mainsprings 820 (see FIG. 4) and the rear mainspring 840 (see FIG. 4), so it can be driven at a resonance frequency. For example, if the supporter 320 is made from a non-ferrous metal like aluminum, although the piston 300 (see FIG. 4) may be made from a metal, the supporter 320 will not be affected by the permanent magnet 460 (see FIG. 4). This makes it easier to couple the piston 300 (see FIG. 4) to the supporter 320.

As noted above, the advantages of making the supporter 320 from a non-ferrous metal of low density are that the resonance conditions can be satisfied and that the supporter 320 and the piston 300 (see FIG. 4) can be coupled more easily. On the contrary, a contact area 327S between the supporter 320 and the front mainspring 820 (see FIG. 4) is likely worn out by friction with the front mainspring 820 (see FIG. 4) during the operation. When the supporter 320 abrades, its abraded powder floats in the refrigerant and circulates along the refrigeration cycle, thereby damaging devices on the refrigeration cycle. To prevent that, the contact area 327S between the supporter 320 and the front mainspring 820 (see FIG. 4) undergoes surface treatment. As an example, the contact area 327S where the supporter 320 comes in contact with the front mainspring 820 (see FIG. 4) is NIP coated or anodized, such that it has surface hardness at least greater than the hardness of the front mainspring 820 (see FIG. 4). Through this configuration scheme, one can present the supporter 320 from being worn away by the front mainspring 820 (see FIG. 4) and producing any abraded powder.

FIG. 7 illustrates one example of a spring guider adapted to FIG. 4. A spring guider 900 includes a nearly annular body 910, a support 920 for supporting a rear mainspring 840 (see FIG. 4) at the center of the body 910, and guides 930 and 940 expanded from both sides of the body 910.

The body 910 of the spring guider 900 has a through hole 910*h* at the center to receive a muffler 700 (see FIG. 4) and a plurality of bolt holes 911 formed around the hole 910*h* to receive bolts that are used for fastening the muffler 700 (see FIG. 4) and the piston 300 (see FIG. 4) together. The support 920 is rearwardly protruded along the circumference of the hole 910*h*. The support 920 is a component into which the rear mainspring 840 (see FIG. 4) is inserted. The rear mainspring 840 (see FIG. 4) is brought into contact with the surrounding area of the hole 910*h* and with the support 920 at the body 910 of the spring guider 900. As such, the area where the spring guider 900 is in contact with the rear mainspring 840 (see FIG. 4) is likely worn out by continuous extension-contraction motion of the rear mainspring 840 (see FIG. 4). In result, abraded powder from the spring guider 900 may flow around with the refrigerant and damage devices on the refrigeration cycle including the linear compressor 100 (see FIG. 4). For this reason, the contact area where the spring guider 900 is in contact with the rear mainspring 840 (see FIG. 4) undergoes surface treatment to prevent the rear mainspring 840 (see FIG. 4) from being worn away. Here, the spring guider 900 preferably has surface hardness greater than the hardness of the rear mainspring 840 (see FIG. 4). Therefore, similar the supporter 320 (see FIG. 6), the spring guider 900 is also NIP coated or anodized for surface treatment.

The guides 930 and 940 of the spring guider 900 each have two guide holes 950 and one bolt hole 960 between the guide holes 950, in which the guide holes 950 are used for center alignment between the spring guider 900 and the piston 300 (see FIG. 4) and the bolt holes 960 are used for bolt-joint between the spring guider 900 and the supporter 320 (see FIG. 6). The guide holes 950 and the bolt holes 960 are formed at positions corresponding to the guide holes 325 (see FIG. 6) and the bolt holes 326 (see FIG. 6) of the supporter 320 (see FIG. 6). By aligning the guide holes 325 (see FIG. 6) of the supporter 320 (see FIG. 6) with the guide holes 950 of the spring guider 900, the center of the rear mainspring 840 (see FIG. 4) that is supported by the spring guider 900 coincides with the center of the piston 300 (see FIG. 4), the supporter 320 (see FIG. 6) and the spring guider 900 are positioned at accurate fastening positions, and the supporter 320 (see FIG. 6) and the spring guider 900 can be bolted together at once by screwing a bolt into each bolt hole 326 (see FIG. 6) of the supporter 320 (see FIG. 6) as well as each bolt hole 960 of the spring guider 900.

FIG. 8 shows one example of a mass member adapted to FIG. 4. In effect, a plurality of mass member 1000 are installed at the positions corresponding to the guides 323 and 324 (see FIG. 6) of the supporter 320 (see FIG. 6) and to the guides 930 and 940 (see FIG. 7) of the spring guider 900 (see FIG. 7), and they are equal to or smaller in size than the guides 323 and 324 (see FIG. 6) of the supporter 320 (see FIG. 6) and to the guides 930 and 940 (see FIG. 7) of the spring guider 900 (see FIG. 7). Preferably, the inner end of each mass member 1000 is curved, so it may not be overlapped with the body 321 (see FIG. 6) of the supporter 320 (see FIG. 6) or with the body 910 of the spring guider 900 (see FIG. 7). In this manner, the mass members 1000 are not overlapped with the rear mainspring 840 (see FIG. 4).

The mass members 1000 are settled at the positions symmetric about the center of the movable members including the piston 300 (see FIG. 4) that linearly reciprocate to promote a stable operation, and if necessary, more than two of them can be stacked in the axial direction. At this time, each of the mass members 1000 is placed carefully so that its guide holes 1001 and bolt holes 1002 are aligned with the guide holes 325 (see FIG. 6) and the bolt holes 326 (see FIG. 6) of the supporter 320 (see FIG. 6), or with the guide holes 950 (see FIG. 7) and the bolt holes 960 (see FIG. 7) of the spring guider 900 (see FIG. 7). By aligning the guide holes 1001 of the mass member 1000 with the guide holes 325 (see FIG. 6) of the supporter 320 (see FIG. 6) and with the guide holes 950 (see FIG. 7) of the spring guider 900 (see FIG. 7), one can ensure that the supporter 320 (see FIG. 6), the spring guider 900 (see FIG. 7), and the mass members 1000 (the mass members 1000 are at the positions symmetric about the center of the piston 300

(see FIG. 4)) are positioned at accurate fastening positions. Accordingly, the supporter 320 (see FIG. 6), the spring guider 900 (see FIG. 7), and the mass members 1000 can be bolted together at once by screwing bolts into the bolt holes 326 (see FIG. 6) of the supporter 320 (see FIG. 6), the bolt holes 960 (see FIG. 7) of the spring guider 900 (see FIG. 7), and the bolt holes 1002 of the mass member 1000.

FIGS. 9 through 11 diagrammatically illustrate the assembly sequence of a movable member in a linear compressor in accordance with the present invention. More details on the assembly sequence of a movable member in a linear compressor will now be provided as follows.

Referring to FIG. 9, the piston 300 (see FIG. 4) and the supporter 320 are positioned in such a way that the center of the piston 300 (see FIG. 4) coincides with the center of the supporter 320, thereby allowing the body 321 of the supporter 320 to be supported on the rear end of the piston 300 (see FIG. 4), and part of the muffler 700 passes through the hole 321*h* formed in the body 321 of the supporter 320 to be settled on the rear side of the body 321 of the supporter 320. Needless to say, it is preferable to align the bolt holes 322 that are formed in the body 321 of the supporter 320 with the bolt holes 700*h* that are formed in the muffler 700.

Referring to FIG. 10, the spring guider 900 is assembled at the rear side of the supporter 320 and the muffler 700, and the muffler 700 passes through the hole 901*h* that is formed in the body 910 of the spring guider 900. At this time, the guide holes 325 (see FIG. 6) of the supporter 320 are aligned with the guide holes 950 of the spring guider 900. In so doing, the center of the spring guider 900 becomes aligned with the center of the piston 300 (see FIG. 4) and the center of the supporter 320. Once the components are located at accurate fastening positions, respectively, bolts B1 are then screwed into the bolt holes 322 formed in the body 321 of the supporter 320, the bolt holes 700*h* formed in the muffler 700, and the bolt holes 910*h* formed in the body 910 of the spring guider 900 in a row, so as to fasten the supporter 320, the muffler 700, and the spring guider 900 to the piston 300 (see FIG. 4) all together.

Referring to FIG. 10 and FIG. 11, the mass members 1000 are stacked axially on the guides 323 and 324 of the supporter 320 and on the guides 930 and 940 of the spring guider 900, and the guide holes 1001 of the mass member 1000 are also aligned with the guide holes 325 of the supporter 320 and with the guide holes 950 of the spring guider 900. Once the components are located at accurate fastening positions, respectively, bolts B2 are then screwed into the bolt holes 1002 formed in the mass member 1000, the bolt holes 326 formed in the guides 323 and 324 of the supporter 320, and the bolt holes 960 formed in the guides 930 and 940 of the spring guider 900, so as to fasten the mass members 1000 to the guides 323 and 324 of the supporter 320 as well as the guides 930 and 940 of the spring guider 900.

Therefore, after the piston 300 (see FIG. 4), the muffler 700, the supporter 320, the spring guider 900, and the mass members 1000 are assembled, as shown in FIGS. 4 through 8, the elastic support is achieved by means of the front mainsprings 820 that are inserted between the supports 327 and 328 of the supporter 320 and the supporting protrusions 543 and 544 of the motor cover 540, and by means of the rear mainspring 840 that is inserted between the support 920 of the spring guider 900 and the back cover 560. Since the mass members 1000, which are coupled to the spring guider 900, maintain a certain space from the outer diameter of the rear mainspring 840, they can be added to the movable member on the condition that they shall not displace the front/rear mainsprings 820 and 840 from their initial positions. Thus, it becomes easier to synchronize the resonance frequency with the operating frequency of the linear motor 400, and as a result thereof, the inconveniences like making changes in design can be reduced and the compression efficiency increases even more.

With reference to drawings, the following will now describe in detail about an embodiment of the application of a supporter 320 that is used for securely affixing a rear mainspring.

FIG. 12 is a side-sectional view of a linear compressor in accordance with the present invention, and FIG. 13 is the mainspring section in a linear compressor in accordance with the present invention.

A linear compressor 100 further includes a frame 520, a stator cover 540, and a back cover 560. For the linear compressor, the cylinder 200 may be fastened to the frame 520, or the cylinder 200 and the frame 520 may be integrately formed as well. In front of the cylinder 200, there is a discharge valve 620 which is elastically supported by an elastic member and goes to an open position or to a closed position selectively by pressure of the refrigerant inside the cylinder 200. Moreover, a discharge cap 640 and a discharge muffler 660 which are seated in front of the discharge valve 620 are fastened to the frame 520. One end of the inner stator 420 and one end of the outer stator 440 are also supported on the frame 520. The other end of the inner stator 420 is supported by a separate member such as an O-ring or by a fixed jaw on the cylinder 200, while the other end of the outer stator 440 is supported by the stator cover 540. The back cover 560 is seated on the stator cover 540, and a suction muffler 700 is placed between the back cover 560 and the stator cover 540.

The supporter 320 is coupled to the rear side of the piston 300. The supporter 320 is provided with mainsprings 800, each mainspring having a natural frequency to help the piston 300 resonate. The mainsprings 800 are divided into front springs 820 both ends of which are supported on the supporter 320 and the stator cover, respectively; and rear springs 840 both ends of which are supported on the supporter 320 and the back cover 560, respectively. Here, the center of the rear mainspring 840 coincides with the center of the piston 300. The suction muffler 700 is settled inside the rear mainspring 840, and is connected at least one of the piston 300 and supporter 320 to introduce refrigerant into the piston 300.

The supporter 320 and the spring guider 900 each have a guide hole at corresponding positions to each other, so as to guide the piston 300 and the rear mainspring 840 to couple to each other concentrically.

FIG. 13 is provided to help understanding the structure of the mainspring section in a linear compressor in accordance with the present invention. First, the rear mainspring is supported by the spring guider 900 and the back cover 560 on both sides for stable affixation.

To elaborate on the structure, the spring guider 900 helps a fastening bolt 340 not contact the rear mainspring 840 directly. The fastening bolt 340 for fastening the piston 300 and the supporter 320 together can have an escape structure in a cavity formed along the circumference of the spring guider 900. The front main springs 820 are supportably held between the supporter 320 and the stator cover 540. Also, the suction muffler 700 passes through the spring guider 900 to get into the housing of the rear mainspring 840.

FIG. 14 is a perspective view of the rear mainspring section in a linear compressor in accordance with the present invention, FIG. 15 is a front view of FIG. 14, and FIG. 16 is a perspective view of the spring guider in a linear compressor in accordance with the present invention.

FIG. 14 clearly shows that the fastening bolt 340 is screwed to a portion of the circumference of the spring guider 900. Since the rear mainspring 840 is supportably head by the spring guider 900, it does not come in direct contact with the fastening bolt 340. The fastening bolt 340 serves to fasten an extended portion of the suction muffler and the supporter 340 together. As the spring guider 900 is thicker than the head of the fastening bolt 340, it provides an escape structure to the fastening bolt 340, while the rear mainspring 840 structurally does not contact the fastening bolt 340. Here, the spring guider 900 is fixed in by a plurality of fastening bolts 340.

Therefore, when the suction muffler 700 is fastened onto the supporter 320, the extended portion 720 of the suction muffler is affixed to the supporter 320 by the fastening bolts 340. And the spring guider 900 with a plurality of cavities, each forming an escape structure for individual fastening bolts 340, is placed on the extended portion 720 of the suction muffler. At this time, the head of each of the fastening bolts 340 is smaller than the depth of the cavities formed in the spring guider 900, so there is no direct contact between the rear mainspring 840 and the fastening bolts 340.

FIG. 15 depicts that the rear mainspring 840 is stably affixed to the spring guider 900. As shown, the spring guider 900 has a plurality of cavities formed in the circumference direction and each cavity is greater in thickness than the head of the fastening bolts 340. In this manner, an escape structure is created for each of the fastening bolts 340, and the rear mainspring 840 does not come into direct contact with the fastening bolts 340 at all. At the same time, the rear mainspring 840 is allowed to have a stable elastic motion. Here, the fastening bolts 340 are used to join the extended portion 720 of the suction muffler and the supporter 320 together.

FIG. 16 provides a detailed schematic view of the spring guider 900. A stepped portion 920 of the spring guider 900 is insertedly fitted into the rear mainspring 840. The plural cavities 940 formed in the circumference of the spring guider has a depth greater than the head of the fastening bolt 340. Moreover, each of the plural cavities 940 serves as an escape structure for each fastening bolt 340, and the rear mainspring 840 may not contact the fastening bolt 340 directly.

Here, a spring guider holder 960 provides a large seat for the rear mainspring 840. The holder 960 increases the installation safety of the rear mainspring 840 and makes sure the rear mainspring 840 does not lean to one side. With the help of the holder 960, the rear mainspring 840 can have an elaborate elastic motion.

Meanwhile, the spring guider holder 960 has a greater hardness than the rear mainspring 840 through surface treatment. This can prevent the production of foreign matters (e.g., abrasion dusts) from abrasion of the rear mainspring 840 that is seated in the spring guider holder 960.

FIGS. 15 through 18 each illustrate an comparative example without the spring guider 900, that is, a structure that is unable to install the rear mainspring 840 reliably.

FIG. 17 is a side view of a linear compressor without a spring guide as a comparative example, FIG. 18 is a side view of a mainspring section without a spring guider as another comparative example, FIG. 19 is a perspective view of a rear mainspring section without a spring guider as yet another comparative example, and FIG. 20 is a front view of FIG. 19.

FIG. 17 shows that in absence of a spring guider the rear mainspring 840 comes in direct contact with the fastening bolt 340. This structure can make a risk factor accounting for an unstable elastic motion of the rear mainspring 830.

FIG. 18 shows that in absence of a spring guider the rear mainspring 840 is placed right on the heads of the fastening bolts 340. Here, the fastening bolts 340 are used to join the piston 300 and the supporter 320 together, so if the rear mainspring 840 is settled right on their heads they may lean to one side, thereby causing the rear mainspring 840 to make an unstable elastic motion. On the other hand, the front mainsprings 820 are supportably affixed between the supporter 320 and the stator cover 540.

FIG. 19 shows an unstable structure where, in absence of a spring guider, the rear mainspring 840 is placed on only a part of the head of each fastening bolt 340. Although the fastening bolts 340 joined the extended portion 720 of the suction muffler with the supporter 320, part of the supporting member of the suction muffler is exposed underneath the rear mainspring 840.

FIG. 20 shows another unstable structure where, in absence of a spring guider, the rear mainspring 840 is placed on only a part of the head of each fastening bolt 340. This unstable structure may impede the elaborate elastic motion, or may crack or abrade the rear mainspring 840 to produce foreign matters.

Meanwhile, the spring guider 900 in a linear compressor of the present invention provides a holder which has a plurality of cavities as escape structures for fastening bolts, so it helps the rear mainspring 840 keep the stable, elaborate elastic motion. In doing so, improvement in performance of the linear compressor and noise prevention can be achieved.

By the use of a smaller number of mainsprings, the linear compressor in accordance with the present invention contributes to a reduction in production costs.

The present invention has been described in detail with reference to the embodiments and the attached drawings. However, the scope of the present invention is not limited to the embodiments and the drawings, but defined by the appended claims.

The invention claimed is:

1. A linear compressor, comprising:

a fixed member including a cylinder for providing a refrigerant compression space;

a movable member including a piston for compressing refrigerant inside the cylinder, a center portion, and a supporter extended from the center portion in a radial direction of the piston so as to perform a linear reciprocating motion about the fixed member;

a plurality of front mainsprings arranged symmetrically about the piston and each having a first end supported on a front side of the supporter and a second end supported on the fixed member;

a single rear mainspring having a first end supported on a rear side of the support of the supporter and a second end supported on the fixed member;

a plurality of mass members coupled to a rear side of the supporter and being positioned a predetermined distance from an outer circumference of the rear mainspring; and a spring guider positioned between the supporter and the rear mainspring, wherein the spring guider has a plurality of cavities formed on a circumferential portion thereof.

2. The linear compressor of claim 1, wherein the plurality of mass members are coupled symmetrically about the center portion of the supporter.

3. The linear compressor of claim 1, wherein the spring guider supports the first end of the rear mainspring.

4. The linear compressor of claim 3, wherein the spring guider is installed at the rear side of the center portion of the supporter to be positioned between the supporter and the rear mainspring.

5. The linear compressor of claim 1, wherein the plurality of mass members are coupled to the spring guider symmetrically about the center portion of the spring guider.

6. The linear compressor of claim 3, further comprising:

a suction muffler positioned inside the piston and the rear mainspring, for introducing refrigerant into the piston, wherein an extended portion of the suction muffler, the spring guider, and the plurality of mass members are sequentially fastened to the rear side of the supporter.

7. A linear compressor, comprising:

a fixed member including a cylinder for providing a refrigerant compression space;

a movable member including a piston for compressing refrigerant inside the cylinder and a supporter having a center portion that coincides with a center of the piston and an extended portion that is connected to the piston and extends in a radial direction of the piston, and which performs a linear reciprocating motion about the fixed member;

a plurality of front mainsprings symmetrically arranged about the center of the piston and the center portion of the supporter and each having a first end supported on a front side of the supporter and a second end supported on the fixed member;

a single tear mainspring having a first end supported on the supporter, and which is positioned on a different side from the piston;

a suction muffler which is engaged with and linearly reciprocates with the movable member to provide a passage for introducing refrigerant, and which reduces noise;

a plurality of mass members coupled to a rear side of the supporter and being positioned a predetermined distance from an outer circumference of the rear mainspring; and a spring guider positioned between the supporter and the rear mainspring, wherein the spring guider has a plurality of cavities formed on a circumferential portion thereof.

8. The linear compressor of claim 7, wherein the spring guider supports the first end of the rear mainspring.

9. The linear compressor of claim 7, wherein the plurality of cavities of the spring guider are formed such that an end portion in a depth direction of a fastening member that fastens the supporter and the suction muffler is not exposed from the plurality of cavities.

10. The linear compressor of claim 8, wherein the spring guider includes a holder which contacts at least the rear mainspring and which has a greater hardness than that of the rear mainspring.

11. The linear compressor of claim 8, wherein the spring guider has a stepped portion into which the first end of the rear mainspring is insertedly fitted.

12. The linear compressor of claim 8, wherein the plurality of mass members are coupled to the spring guider symmetrically about a center portion of the spring guider.

13. The linear compressor of claim 7, wherein the plurality of mass members are coupled to the spring guider symmetrically about the center portion of the supporter.

14. The linear compressor of claim 8, wherein the supporter and the spring guider each have guide holes for guiding them to accurate fastening positions, the guide holes being located at positions corresponding to each other.

15. The linear compressor of claim 7, wherein the supporter includes a holder that guides a suction muffler body to be aligned with respect to the supporter.

16. The linear compressor of claim 7, wherein the suction muffler is made from an injection moldable material.

17. The linear compressor of claim 1, further comprising:

a back cover having one of bent portions or protruded portions to secure a second end of the rear mainspring.

18. The linear compressor of claim 1, wherein the plurality of front mainsprings and the rear mainspring each have a natural frequency that approximately synchronizes with a resonance frequency of the piston.

19. A linear compressor, comprising:

a fixed member including a cylinder for providing a refrigerant compression space;

a movable member, including:

a piston for compressing refrigerant inside the cylinder; and a supporter having a center portion that coincides with a center of the piston and an extended portion that is connected to the piston and extends in a radial direction of the piston, and which performs a linear reciprocating motion about the fixed member, wherein the supporter includes a holder that guides a suction muffler body to be aligned with respect to the supporter;

a plurality of front mainsprings symmetrically arranged about the center of the piston and the center portion of the supporter and each having a first end supported on a front side of the supporter and a second end supported on the fixed member;

a single rear mainspring having a first end supported on the supporter, and which is positioned on a different side from the piston;

a suction muffler which is engaged with and linearly reciprocates with the movable member to provide a passage for introducing refrigerant, and which reduces noise; and a plurality of mass members coupled to a rear side of the supporter and being positioned a predetermined distance from an outer circumference of the rear mainspring.

* * * * *